United States Patent [19]

Friedman

[11] 3,930,327

[45] Jan. 6, 1976

[54] SIGNBOARD ASSEMBLY

[75] Inventor: Stanley Friedman, Lancaster, Pa.

[73] Assignee: Banner Board Company, Lancaster, Pa.

[22] Filed: Nov. 7, 1974

[21] Appl. No.: 521,733

[52] U.S. Cl. ..... 40/125 R; 40/140

[51] Int. Cl.[2] ..... G09F 7/08

[58] Field of Search ..... 40/140, 141, 142 R, 143, 40/125 E, 125 R, 152, 156, 132 D, 125 F

[56] References Cited

UNITED STATES PATENTS

| | | | |
|---|---|---|---|
| 3,154,870 | 11/1964 | Hopp et al. | 40/140 X |
| 3,173,220 | 3/1965 | Lachenmeier | 40/140 |
| 3,230,652 | 1/1966 | McNair | 40/140 X |
| 3,235,989 | 2/1966 | Brooks | 40/130 R |
| 3,458,945 | 8/1969 | Edwards | 40/140 |
| 3,720,012 | 3/1973 | Loper | 40/140 |
| 3,722,120 | 3/1973 | Finkel | 40/140 |
| 3,778,915 | 12/1973 | Freeman et al. | 40/140 X |

*Primary Examiner*—Louis G. Mancene
*Assistant Examiner*—John F. Pitrelli
*Attorney, Agent, or Firm*—John C. Thompson

[57] ABSTRACT

A signboard construction including four frame members which support a plurality of signboard members capable of receiving indicia on either side thereof. The frame members and the signboard members are all formed from aluminum extrusions. Each of the signboard members has a principal vertically extending structure, an upper structure which forms a groove, and three pairs of mounting ribs, the lower two pairs of ribs being mounted on intermediate spaced apart portions of the principal structure and the upper pair of mounting ribs being mounted on the groove forming structure. The lower edge of one signboard member can be received within the groove forming structure of another signboard member and in this manner a plurality of signboard members can be assembled together. The ends of the top, bottom, and end frame members are cut at 45 degree angles and are secured to each other by corner angles. Each of the frame members includes an inner portion provided with a first channel of relatively large width capable of receiving a pair of mounting ribs and a second channel disposed in the middle of the first channel, the second channel having a relatively small width capable of receiving the lower edge of the principal structure of a signboard member. When the parts are assembled together the first channel of the top frame member receives the top pair of mounting ribs of the top signboard member, and the second channel of the bottom frame member receives the lower edge of the bottom signboard member.

6 Claims, 4 Drawing Figures

SIGNBOARD ASSEMBLY

FIELD OF THE INVENTION

The present invention relates generally to a signboard construction, and more particularly to a signboard construction formed of a plurality of substantially identical signboard members mounted within a frame formed from frame members of substantially identical cross-section, the signboard construction being capable of bearing indicia on both sides of the signboard members, the indicia being of varying incremental heights.

BACKGROUND OF THE INVENTION

Various signboard constructions are shown in the prior art, one such construction being shown in U.S. Pat. No. 3,722,120 granted Mar. 27, 1973 to Henry Finkel. This Patent discloses a signboard construction having a four member frame formed of four aluminum extrusions having identical cross-sections, and a plurality of signboard members received within the frame members. Each of the signboard members of Finkel is formed of an aluminum extrusion having a lower portion of complex cross-section interconnected to the lower edge of a principal vertically extending portion, the lower portion including a pair of mounting ribs, the extrusion also including an upper V-shaped portion interconnected to the upper edge of the vertically extending portion, the ends of the V-shaped portion being received within a channel formed by the lower portion. While the construction of Finkel is generally satisfactory, each of the signboard members is unduly complex, and furthermore the Finkel construction requires a separate signboard member for each of the incremental widths of the indicia which are adapted to be carried thereby. Finkel also requires a special adapter for mounting the indicia on his signboard members. The frame members of Finkel are open on one side and this has the disadvantage in that they may collect dirt and water which may make subsequent disassembly of the signboard construction difficult. Also no means are provided for readily mounting his assembled signboard.

Another signboard construction shown in the prior art is U.S. Pat. No. 3,289,340 issued Dec. 6, 1966 to Edwards. This patent discloses a signboard construction wherein each of the extruded signboard members is provided with a plurality of equally spaced apart indicia receiving members. The upper and lower edges of each of the signboard members are provided with special interfitting surfaces which unduly complicate the extrusion. Special adapters are required for mounting indicia on the signboard members. The frame of this patented design is formed of wood and such a frame member construction is undesirable because of the maintenance required to preserve the wood.

Other U.S. Patents which are representative of the prior art are: Nos. 3,230,652, 3,458,945, 3,696,541, 3,685,186, 3,793,757, and 3,651,592. The first three of these Patents disclose a signboard construction wherein a plurality of signboard members are interconnected to each other, the upper and the lower edges of each of the signboard members being provided with a special interfitting construction. Many of these prior art signboard constructions require special appliances for mounting the indicia on the signboard members. Others require special adapters for interconnecting the signboard members to the frames. Furthermore, none of these patents disclose structure whereby the assembled signboard can be readily mounted.

OBJECTS AND SUMMARY OF THIS INVENTION

It is an object of the present invention to provide a signboard construction of simplified construction.

It is a further object of the present invention to provide a signboard construction having extruded frame members and signboard members, wherein special adapters are not required for mounting indicia upon the signboard members.

It is another object of the present invention to provide an improved signboard construction wherein the parts may be readily assembled to each other in such a manner that the various parts are securely held together.

It is another object of the present invention to provide an improved signboard construction wherein the assembled signboard may be readily mounted.

The above objects of the present invention are attained by providing a rectangular frame having top, bottom, and a pair of end frame members which are all of identical cross-section, each of the frame members being provided with grooves on an inner portion thereof to receive associated parts of a plurality of juxtapositioned signboard members, the signboard members having a plurality of equally spaced apart mounting ribs, the upper pair of mounting ribs being mounted on groove forming means which is adapted to receive the lower edge of the main structural element of an associated signboard member when the signboard members are assembled in juxtapositioned relationship with respect to each other.

The above and other objects and advantages of this invention will be apparent to those skilled in the art after a consideration of the following detailed description taken in conjunction with the accompanying drawings in which a preferred form of this invention is illustrated.

DETAILED DESCRIPTION OF A PREFERRED EMBODIMENT

Figure 1:
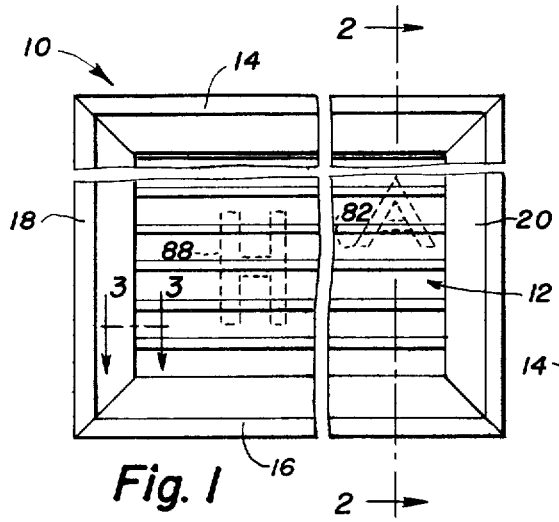
FIG. 1 is a front view, partially broken away, of a signboard construction made in accordance with the principles of this invention, two differing sizes of indicia being shown in phantom lines.
Figure 2:
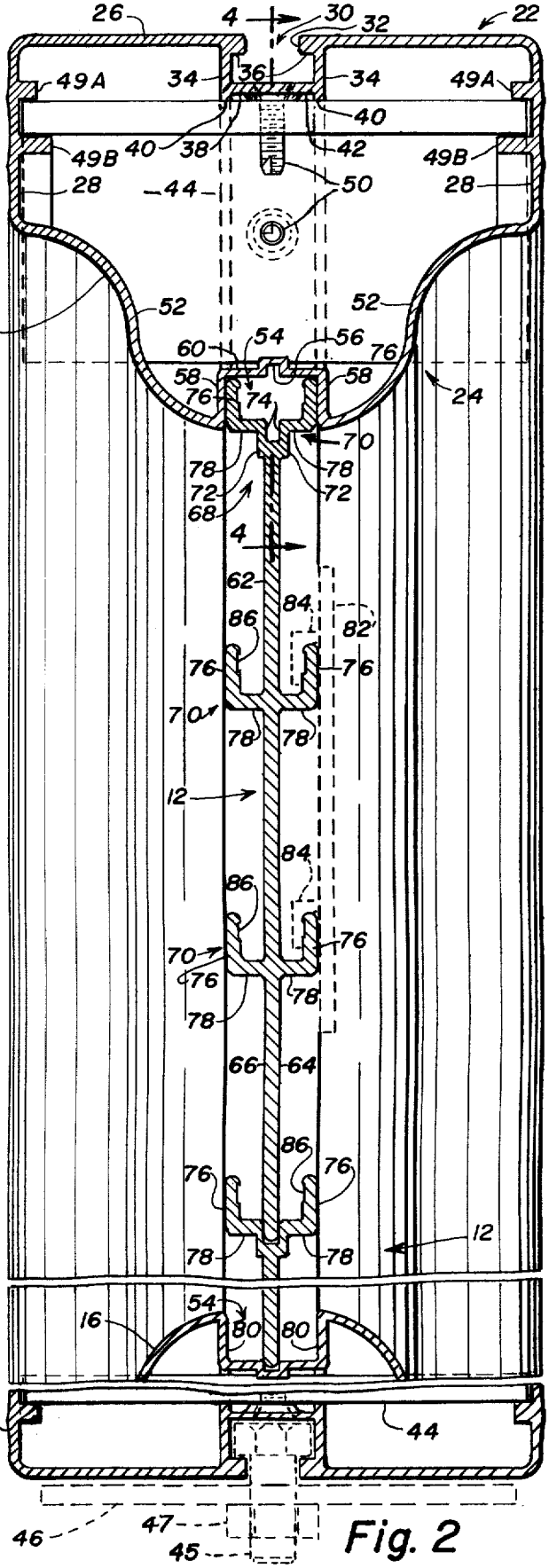
FIG. 2 is an enlarged sectional view taken generally along the lines 2—2 in FIG. 1, parts being partially broken away, one indicia being shown in phantom lines, and a frame mounting member also being shown in phantom lines.

The signboard construction, which is indicated generally at 10 in FIG. 1, includes a plurality of frame members and a plurality of signboard members. The signboard members, which are indicated generally at 12 in FIG. 2, are supported by a top frame member 14, a bottom frame member 16, a left-hand end frame member 18, and a right-hand end frame member 20. Each of the top, bottom, and end frame members is formed from an aluminum extrusion of identical cross-section and includes a wide outer portion, indicated generally at 22 in FIG. 2, and a reduced inner portion indicated generally at 24. Each of the wide outer portions includes a transversely extending base portion 26 and oppositely disposed sidewall portions 28. A recessed mounting channel, indicated generally at 30, is formed in the base portion 26 midway between the sidewall portions 28. To this end, the base portion is provided with a slot 32, and sidewalls 34 extend toward the reduced inner portion 24 from the inner surface of the base portion 26, the sidewalls being spaced away from the slot 32 a small amount so that the facing portions 36 of the base portion 26 adjacent the slot 32 overhang the sidewalls 34. An intermediate member 38 extends between the sidewalls 34, the sidewalls 34 extending a slight distance beyond the intermediate member 38, the extension 40 of the sidewalls 34 forming a mounting surface for corner brackets 44.

Figure 4:
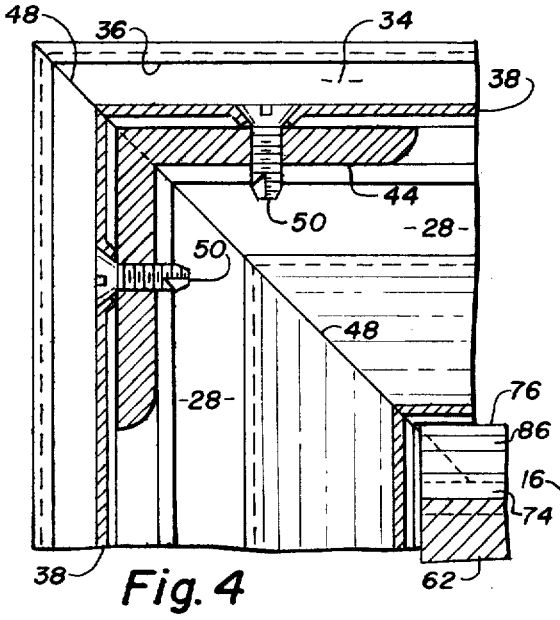
FIG. 4 is a sectional view taken generally along the lines 4—4 in FIG. 2 showing the manner in which adjacent frame members are interconnected to each other.

The recessed mounting channel formed by the overhanging portions 36, the sidewalls 34, and the intermediate member 38 are for the purpose of receiving mounting members indicated in phantom at 45 at the bottom of FIG. 2, the mounting members being for the purpose of securing the signboard assembly in its desired location. The mounting members are preferably bolts with the head end of the bolt being received within the channel, the threaded portion of the bolt passing through an aperture in a member 46 to which the signboard assembly is to be secured, the bolt and the signboard members being secured in place by a nut indicated at 47 at the bottom of FIG. 2. The corner brackets are for the purpose of interconnecting the various frame members to each other and the manner in which they serve this purpose can best be seen from FIGS. 2 and 4. In this connection it should be noted that each of the adjacent edges of a frame member is cut along a 45° line indicated at 48 and are mated together. The corner brackets 44 secure the edges together, the brackets extending the full width of the associated frame members. The sides of the brackets are received between spaced apart flanges 49*a*, 49*b*. The full width brackets thus not only are used for securing the various frame members together but give added stability and strength due to their interconnection with the flanges 49*a* and 49*b*. The brackets are in turn secured in place to the associated frame members by screws 50, the head end of the screws being received within recessed portions of the inner surface 42. By disposing the corner brackets inwardly from the base portion 26 it is possible to mount the assembled signboard by bolts 45 at any location. With this construction it is not necessary to drill the frame members for mounting.

The reduced inner portion of each of the frame members includes opposed curved members 52 which are joined together adjacent their inner edges by structure which forms a first channel 54 of relatively large width, and a second channel 56 of relatively small width, the second channel being disposed within the middle of the first channel. The structure which forms the channels includes a pair of walls 58 which extend towards the wide outer portion from the adjacent inner edges of the curved members 52, and a transversely extending member 60 which is provided with the second channel 56 as can best be seen from FIG. 2.

Each of the signboard members 12 is also an aluminum extrusion, and includes a principal vertically extending structure 62 having opposed parallel vertical sidewalls 64, 66, groove forming means indicated generally at 68, and a plurality of equally spaced apart mounting rib means indicated generally at 70. As can be seen from FIG. 1 the mounting rib means extend from one end to the other end of each of the signboard members. In the preferred embodiment shown in these drawings, each of the signboard members is provided with three equally spaced apart mounting rib means. Each of the groove forming means includes two spaced apart parallel vertical portions 72 which are integral with the opposed sides 64, 66 of the upper end of the principal vertically extending structure 62. The spaced apart parallel vertical portions have facing sidewalls 74 which are approximately in line with said opposed parallel vertical sidewalls 64,66.

Each of the spaced apart mounting rib means includes a pair of L-shaped members, each of the L-shaped members having a vertical leg 76 and a lower horizontal leg 78. The lower horizontal leg 78 of the upper pair of mounting rib means is integral with the spaced apart parallel vertical portions 72. The ends of the horizontal legs remote from the vertical legs 76 of the intermediate and lower rib means are integral with the principal vertically extending structure 62. A portion of the principal vertically extending structure 62 extends below the lowermost mounting rib means and is so dimensioned that when it is associated with an adjacent signboard member that the spacing between the lowermost mounting rib means and uppermost adjacent mounting rib means of the adjacent signboard member is the same as the spacing between the lowermost mounting rib means and the intermediate mounting rib means.

Figure 3:
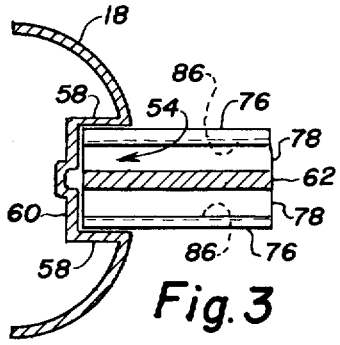
FIG. 3 is an enlarged sectional view taken generally along the lines 3—3 in FIG. 1.

When the various parts are assembled to form a signboard it should be observed that the first channel 54 of the top frame member 14 receives the upper edge of the uppermost signboard member. Thus, the spacing between the facing sidewalls 80 of the first channel are so dimensioned with respect to the outer surfaces of the vertical leg portions 76 that the vertical legs are snugly embraced in the fist channel. In like regard, the second channel 56 is so dimensioned with respect to the sidewalls 64, 66 of the principal portions 62 that the lower edge of the principal portions 62 is snugly embraced within the second channel 56. Adjacent signboard members are interconnected with respect to each other by disposing the lower edge of the principal vertically extending structure 62 within the groove defined by the groove forming means 68. Thus, the dimensioning of the facing sidewalls 74 is such that the lower edge of the principal portion 62 is snugly received within the groove forming means. Each of the mounting ribs, which as noted above extends from one side to the other of each of the signboard members, is received within the first channel 54 of each of the right or left hand end members in the manner illustrated in FIG. 3.

As can be seen from the Figures, when the signboard is assembled in the manner indicated in FIG. 2, indicia of differing incremental widths can be mounted on the mounting rib means. Thus, for example, an indicia of a first incremental height as indicated in phantom at 82 in FIG. 2 may be mounted on adjacent mounting rib means, the indicia means 82 bearing mounting means 84 which extend over and around the top edge of the vertical leg 76. In order to insure securement of the indicia means, the leg means may be provided with an inner groove 86. A larger indicia, which is secured to spaced apart mounting rib means is shown at 88 in FIG. 1. The indicia are of a type which are commercially available, and no special adapters are required to mount them.

While the preferred structure in which the principles of the present invention have been incorporated is shown and described above, it is to be understood that the invention is not to be limited to the particular details, shown and described above, but that, in fact widely differing means may be employed in the practice of the broader aspects of the invention.

What is claimed is:

1. A signboard assembly comprising in combination:

a rectangular frame including top, bottom, and a pair of end frame members, each of said frame members including an inner portion provided with a first channel of relatively large width and a second channel disposed in the first channel, the second channel having a relatively small width; and a plurality of juxtapositioned free floating horizontally extending signboard members confined within and supported by said rectangular frame, without mechanical locking means each of said signboard members including a principal vertically extending structure having opposed parallel vertical sidewalls;

groove forming means which define a vertically extending mounting groove having independant generally parallel sidewalls approximately in line with said opposed parallel vertical sidewalls; and a plurality of equally vertically spaced apart mounting rib means;

the upper edge of said signboard member including an upper one of said plurality of vertically spaced apart mounting rib means and said groove forming means; and said plurality of spaced apart mounting rib means including L-shaped members having a vertical leg and a lower horizontal leg, the end of the horizontal leg remote from the vertical leg of said upper one of said plurality of vertically spaced apart mounting rib means being integral with an upper portion of the groove forming means, and the end of each horizontal leg remote from the associated vertical leg of the plurality of vertically spaced apart mounting rib means disposed below said upper one of the vertically spaced apart mounting rib means being integral with a side of the principal extending structure;

the upper edge of the uppermost signboard member being received within the first channel of the top frame member for free floating movement, the lower end of the principal vertically extending structure of the lowermost signboard member being received within the second channel of the bottom frame member for free floating movement, and a lower adjacent signboard member receiving the lower end of the principal vertically extending structure of the upper adjacent signboard member within its groove forming means for free floating movement.

2. A signboard assembly as set forth in claim 1 wherein each of said frame members is formed from an aluminum extrusion, said frame members having substantially identical cross-sections.

3. A signboard assembly as set forth in claim 1 wherein each of said frame members includes an outer portion of greater width than the inner portion, and in which the second channel is disposed within the middle of the first channel.

4. The signboard assembly set forth in claim 1 wherein each of the mounting rib means includes a pair of oppositely disposed mounting ribs.

5. A signboard assembly comprising in combination:

a rectangular frame including top, bottom, and a pair of end frame members joined at their corners, each of said frame members having an identical cross-section and including wide outer portion and a reduced inner portion, the wide outer portion of each of said frame members being provided with a recessed mounting channel, and the reduced inner portion being provided with a first channel of relatively large width and a second channel disposed in the middle of the first channel, the second channel having a relatively small width; and a plurality of juxtapositioned free floating horizontally extending double sided substantially identical signboard members confined within and supported by said rectangular frame without mechanical locking means, each of said signboard members including a principal vertically extending structure having opposed parallel vertical sidewalls;

groove forming means which define a vertically extending mounting groove having independant parallel vertically extending structures defining facing sidewalls approximately in line with said opposed parallel vertical sidewalls said groove forming means being integral with the upper portion of said principal vertically extending structure; and a plurality of equally vertically spaced apart mounting rib means, each of said mounting rib means including a pair of L-shaped members having a vertical leg and a lower horizontal leg, the end of each of the horizontal legs remote from the associated vertical leg of the upper pair of L-shaped members being integral with the upper edges of the vertically extending structures of the groove forming means, and the end of the horizontal legs remote from the associated vertical legs of the pairs of L-shaped members disposed below said upper pair of L-shaped members being integral with the principal vertically extending structure;

the parts being assembled with the vertical legs of the uppermost mounting rib means of the top signboard member being received within the first channel of the top frame member for free floating movement, the lower end of the principal vertically extending structure of the lowermost signboard member being received within the second channel of the bottom frame member for free floating movement, and a lower adjacent signboard member receiving the lower end of the principal vertically extending structure of the upper adjacent signboard member within its groove forming means for free floating movement.

6. The signboard assembly set forth in claim 5 in which each of the signboard members is provided with three equally spaced apart mounting rib means, the lowermost mounting rib means of one signboard member being spaced an equal distance away from the mounting rib means immediately above the lowermost mounting rib means and the uppermost mounting rib means of a lower adjacent signboard member.

* * * * *